United States Patent [19]

Louch et al.

[11] 4,325,322

[45] Apr. 20, 1982

[54] LIQUID APPLICATOR FOR TEXTILE YARNS

[75] Inventors: James B. Louch; William Postman, both of Anderson, S.C.; Thomas A. Ward, Lubbock, Tex.; Willis E. Cole, Anderson, S.C.

[73] Assignee: Badische Corporation, Williamsburg, Va.

[21] Appl. No.: 81,705

[22] Filed: Oct. 4, 1979

[51] Int. Cl.[3] ..... B05C 3/15

[52] U.S. Cl. ..... 118/410; 68/200; 118/419; 118/420; 118/DIG. 19; 118/DIG. 22

[58] Field of Search ..... 118/DIG. 19, DIG. 22, 118/419, 410, 420, 234; 68/200, 205 R; 156/175, 441

[56] References Cited

U.S. PATENT DOCUMENTS

| | | | |
|---|---|---|---|
| 1,240,625 | 9/1917 | Taylor | 118/DIG. 19 |
| 2,678,676 | 5/1954 | Slovin | 118/DIG. 22 |
| 2,861,393 | 11/1958 | Whitehurst et al. | 118/DIG. 19 |
| 3,827,397 | 8/1974 | Hebberling et al. | 118/420 X |
| 3,854,441 | 12/1974 | Park | 118/410 X |
| 4,095,558 | 6/1978 | Ellegast et al. | 118/420 |
| 4,176,619 | 12/1979 | Wappling | 118/410 |

*Primary Examiner*—Shrive P. Beck
*Attorney, Agent, or Firm*—G. F. Helfrich

[57] ABSTRACT

A liquid receptacle in the form of a chamber has a slit in one section thereof, the elongated sides of the slit being parallel straight lines. The chamber communicates through another section thereof with means for the supply thereto of a liquid treating composition at a controlled rate. Guide means configures a traveling multi-filament textile yarn in a close-packed monofilamentary layer and directs the so-configured traveling textile yarn under a desired tension and at a right angle over the slit and in contact with the chamber at a point downstream of the slit and in proximity thereto. The minimum length of the slit is equal to the total width of the traveling textile yarn when configured in a close-packed monofilamentary layer; and the width of the slit is between about 0.001 and 0.01 inches.

4 Claims, 2 Drawing Figures

LIQUID APPLICATOR FOR TEXTILE YARNS

BACKGROUND OF THE INVENTION

1. Field of the Invention

The present invention relates to textiles in general, and in particular to a device for the application of a liquid treating composition uniformly over the width and along the length of a traveling textile yarn made up of a plurality of individual filaments.

2. Prior Art Statement

In the manufacture of synthetic fibers, it is generally required to apply a lubricating liquid composition as soon as possible after the filaments have been solidified. The purpose of this lubricating liquid is to reduce friction against other fibers and against elements of processing machinery, as well as to lower the surface resistivity of the fibers, thereby reducing the static electric charge thereon.

However, uniformity of appliction of the liquid treating composition has not been achieved through the utilization of devices of the prior art. By far the most widely employed of such devices is one which comprises a ceramic roll which, partially submerged, rotates in a pan containing the liquid to be applied. The fibers or yarns are caused to travel over, and to contact the non-submerged surface of this roll, picking up adsorbed liquid therefrom. (See, for example, U.S. Pat. No. 3,549,740, which is among many recently devised processes which still employ this basic device). The lack of uniformity in the application of liquid treating compositions by means of these and related prior art devices is evidenced by undesirable, wide variations in the amount of treating agent actually found in identical yarns separately treated by identical devices. That such variations are unacceptable is clear in view of today's requirements for greater uniformity in finished products, as well as enhanced speed and efficiency in manufacturing operations.

The closest prior art is considered to be British Pat. No. 1,478,480, which discloses an apparatus for the quantitative application of a liquid agent in a thin layer to fibers or filaments moving uniformly along a linear path. This apparatus comprises a liquid container having an inner compartment equipped with a feed pipe for the liquid agent. The inner compartment opens into a slit which is perpendicular to the path of the fibers or filaments. The outlet of the slit is defined by walls which are either uniformly curved concavely or provided with two or more concave recesses. Such a curvature of the slit is required in order to ensure uniform application of the liquid agent.

The present invention differs from that disclosed in British Pat. No. 1,478,480 in certain significant aspects. First of all, it is essential that the elongated sides of the slit are parallel straight lines, contrary to the teachings of the British patent. Secondly, it is essential that the device of the present invention is provided with means for configuring a traveling textile yarn in a close-packed monofilamentary layer and directing the so-configured traveling textile yarn over the slit and in contact with the chamber at a point downstream of the slit and in proximity thereto. Such ensures that: (a) liquid treating agent is in fact forced into the traveling yarn and not drawn thereto by aspiration; (b) uniformity of application of the liquid treating agent is achieved across the threadline, along the threadline, and from threadline to threadline; and (c) there is minimal abrasion of fiber surfaces, which could otherwise be severe as a result of direct contact thereof with the edges of the slit, especially after extensive use of the device. None of the above limitations nor the advantages of their employment are suggested by the disclosure of British Pat. No. 1,478,480.

SUMMARY OF THE INVENTION

The inadequacies of prior art devices are avoided by the provision of a liquid applicator for textile yarns comprising: (a) a liquid receptacle in the form of a chamber having a slit in one section thereof, the elongated sides of the slit being parallel straight lines substantially perpendicular to the path of a traveling textile yarn, the chamber communicating through another section thereof with means for the supply thereto of a liquid treating composition at a controlled rate; the slit having a minimum length equal to the total width of the traveling textile yarn when configured in a close-packed monofilamentary layer; the slit having a width of between 0.001 and 0.01 inches; and (b) guide means for configuring the traveling textile yarn in a close-packed monofilamentary layer and directing the so-configured traveling textile yarn at a desired tension over the slit and in contact with the chamber at a point downstream of the slit and in proximity thereto. It has been found especially advantageous if the guide means comprises a pair of cooperating stationary spools, one spool being located on each side of the chamber in proximity thereto, the spool on the upstream side of the chamber having a cylindrical contact surface, and the spool on the downstream side of the chamber having an arcuate contact surface. The very best results are obtained when the chamber and the pair of cooperating spools are fabricated from a wear-resistant material. Ceramic compositions are ideally suited for this purpose.

BRIEF DESCRIPTION OF THE DRAWINGS

For a more complete understanding of the present invention, reference should be made to the Detailed Description of the Preferred Embodiments, which is set forth below. This detailed description should be read together with the accompanying drawings, wherein.

DETAILED DESCRIPTION OF THE PREFERRED EMBODIMENTS

Figure 1:
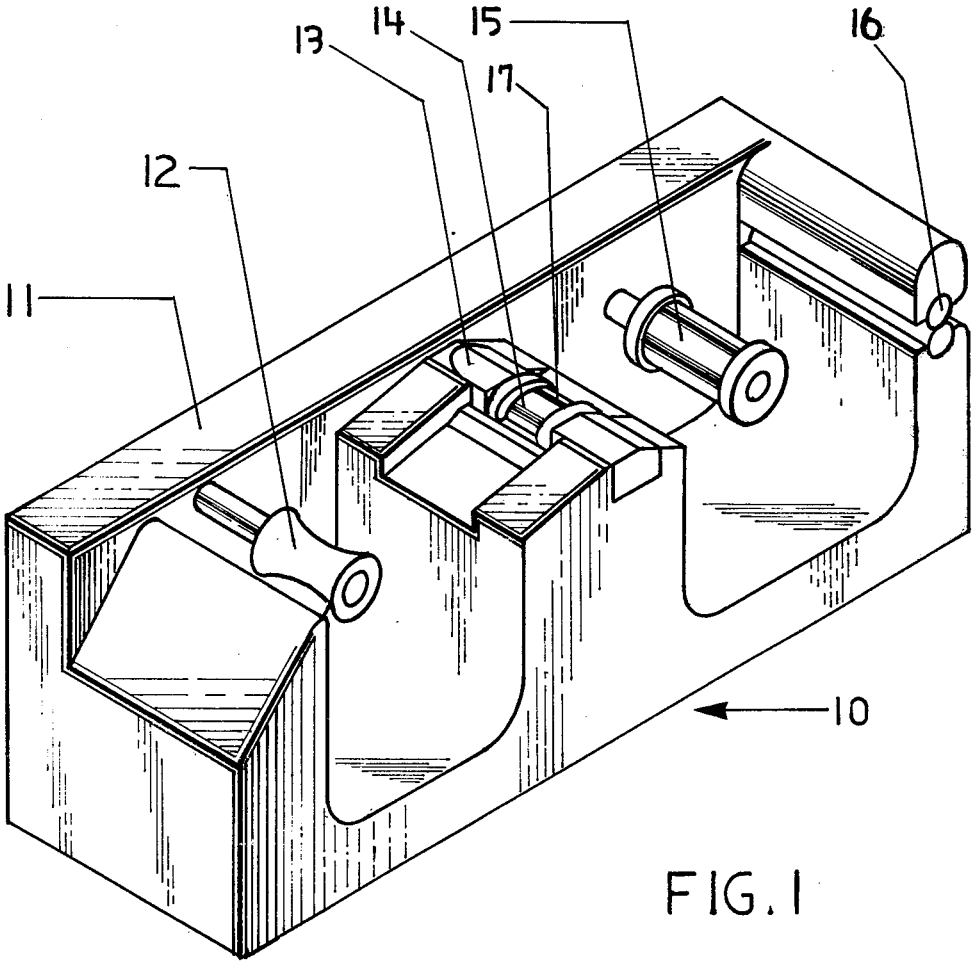
FIG. 1 is a perspective view showing a preferred embodiment of the present invention.
Figure 2:
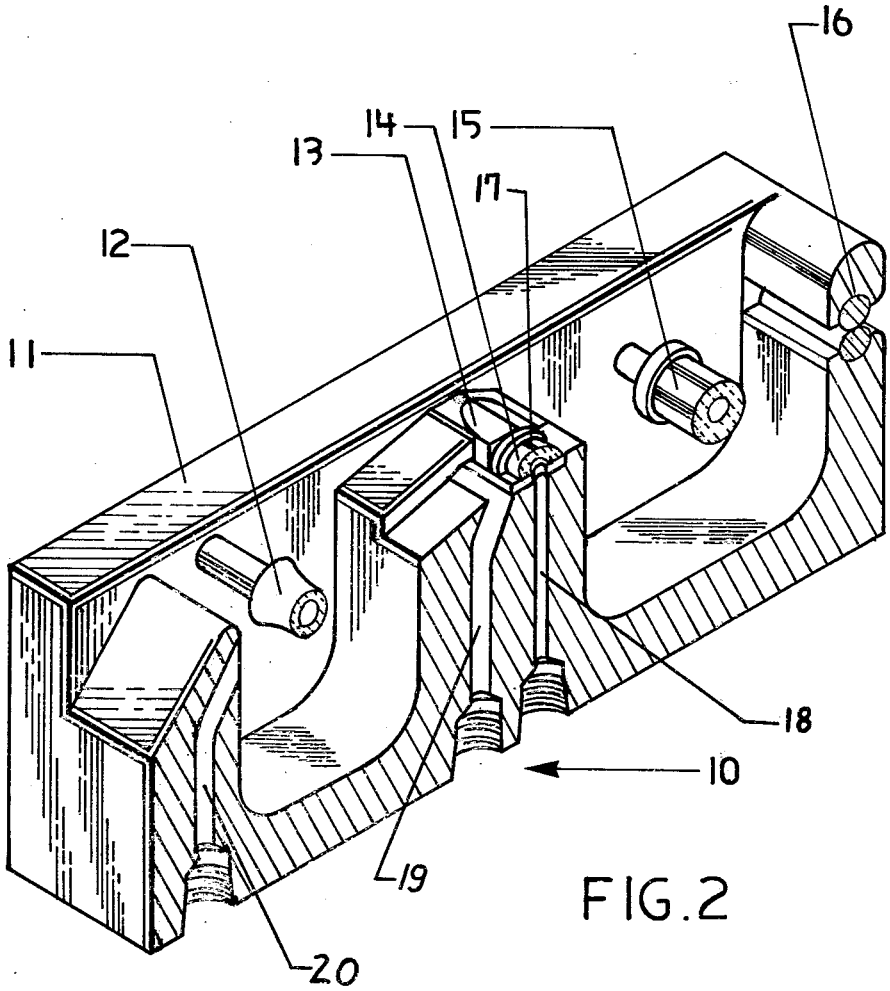
FIG. 2 is a partial sectional perspective view of the same embodiment depicted in FIG. 1.

Referring now to the drawings, there is shown a device (10) according to the present invention. Device (10) includes a liquid receptacle in the form of chamber (14), which has slit (17) in the upper or exposed section thereof, the elongated exposed edges of slit (17) being parallel straight lines. When device (10) is in operation, a traveling textile yarn will pass over slit (17) in a path substantially perpendicular to the parallel straight lines which are the elongated sides of slit (17). Chamber (14) is securely mounted in the proper position in block (11) by means of adapter (13), which is seen in FIG. 1 to comprise two sections which are disposed laterally with respect to chamber (14). Chamber (14) communicates through the unexposed section thereof with a means for the supply thereto of a liquid treating composition at a controlled rate. Pictured in FIG. 2 is a communicating means, viz., passageway (18), through which a liquid treating composition is directed at a controlled rate to chamber (14) from a source of supply such as a metering pump (not shown). Passageways (19) and (20) as shown in FIG. 2 provide drains for the liquid treating composition, such drains having utility at the instants of start up and completion of the liquid application operation. (As will be understood by those of skill in this art, during the actual application of a liquid treating composition employing a device according to the present invention, there is no excess of liquid to be drained off, nor is there any insufficiency of liquid. By means of a device according to the present invention, the desired amount of a liquid treating composition is forced onto a traveling textile yarn. There is no oversupply of liquid present nor is any liquid taken up by aspiration. As a result, there is a uniform application of the liquid treating composition over the entire width and along the entire length of the traveling textile yarn.)

The traveling textile yarn to be treated is configured by guide means in a close-packed monofilamentary layer and directed in such a configuration at a desired tension over slit (17) and in contact with chamber (14) at a point downstream of slit (17) and in proximity thereto. The minimum length of slit (17) must be equal to the total width of the traveling textile yarn when configured in a close-packed monofilamentary layer, and the width of slit (17) must be between 0.001 and 0.01 inches, in order for uniform application of a liquid treating composition to result. Guide means especially suitable in providing the proper yarn configuration, direction, and tension is advantageously a pair of cooperating stationary spools (15) and (12), as shown in the drawings. Spool (15), which is located on the upstream side of chamber (14) in proximity thereto, has a cylindrical contact surface. Spool (12), which is located on the downstream side of chamber (14) in proximity thereto, has an arcuate contact surface (i.e., the surface is an arc of a circle of a given radius, as depicted in the drawings).

For best results, chamber (14) as well as spools (15) and (12), should be fabricated from any of a number of wear-resistant materials, the most desirable of which are standard ceramic compositions. Block (11) with passageways (18), (19), and (20), may be produced from any of a wide variety of standard materials of construction. The same applies to the production of adapter (13). Slit (17) is advantageously formed in chamber (14) by an incising procedure known to those of skill in the art.

If desired, a slub catcher (16) may be also employed, as shown in the drawings. Such a slub catcher, which is located on the upstream side of spool (15), conveniently comprises two elongated cylindrical pins which are fixedly mounted on block (11) with their longitudinal axes parallel. These pins are spaced from each other to form a gap, through which the textile yarn to be treated is caused to travel, and by means of which slubs are prevented from passing through the device.

In the employment of a preferred embodiment of a device (10) according to the present invention to apply a liquid treating composition to a traveling textile yarn comprising a plurality of individual filaments, a yarn from a suitable source is first passed through the gap in slub catcher (16). Thence the yarn is passed under and in contact with the surface of cylindrical spool (15), then over slit (17) formed in chamber (14), then over and in contact with the surface of arcuate spool (12), and finally attached to a suitable take up means (not shown), by means of which tension is applied. Spool (15) cooperates in effecting the proper angle and position of contact of the yarn with chamber (14), and pretensions the yarn so that extraneous motion thereof is eliminated. Spool (12) dresses the yarn down to the proper dimension and cooperates with spool (15) in effecting the proper angle and position of contact of the yarn with chamber (14). Such a proper contact is at a point downstream of slit (17) and in proximity thereto, advantageously at an angle of up to about 30 degrees greater than the tangent. A uniform distribution of the yarn in a monofilamentary layer perpendicular to the longitudinal axis of slit (17) is effected by arcuate spool (12), as a result of the gradation in filament to filament tension across the layer, which is caused by the arcuate contact surface of the spool. A liquid treating composition is introduced into passageway (18) at a rate which is predetermined and controlled, as by means of a metering pump (not shown). Passageways (19) and (20) function as drains at the time of start up and completion of the liquid application operation. During the actual application procedure, a desired amount of the liquid treating agent is continuously forced onto the traveling yarn, uniformity of application of the liquid treating agent being achieved across the threadline, along the threadline, and from threadline to threadline. Moreover, there is minimal abrasion of fiber surfaces. Although the present invention has been described in detail with respect to certain preferred embodiments thereof, it is understood by those of skill in the art that variations and modifications in this detail may be effected without any departure from the spirit and scope of the present invention, as set forth in the hereto-appended claims.

We claim:

1. A device for the application of a liquid treating composition uniformly over the width and along the length of a traveling textile yarn comprising a plurality of individual filaments, which device comprises:

(a) a liquid receptacle in the form of a chamber having a slit in one section thereof, the elongated sides of the slit being parallel straight lines substantially perpendicular to the path of the traveling textile yarn, the chamber communicating through another section thereof with means for the supply thereto of the liquid treating composition at a controlled rate; the slit having a minimum length equal to the total width of the traveling textile yarn when configured in a close-packed monofilamentary layer; the slit having a width of between 0.001 and 0.01 inches; and (b) guide means for configuring the traveling textile yarn in a closed-packed monofilamentary layer and directing the so-configured traveling textile yarn over the slit and in contact with the chamber at a point downstream of the slit and in proximity thereto.

2. The device of claim 1, wherein the guide means comprises a pair of cooperating stationary spools, a spool being located on each side of the chamber in propinquity thereto, the spool on the upstream side of the chamber having a cylindrical contact surface, and the spool on the downstream side of the chamber having an arcuate contact surface.

3. The device of claim 2, wherein the chamber and the pair of cooperating spools are fabricated from a wear-resistant material.

4. The device of claim 3, wherein the wear-resistant material is a ceramic composition.

* * * * *